US008807229B2

(12) United States Patent
Vanderford et al.

(10) Patent No.: US 8,807,229 B2
(45) Date of Patent: Aug. 19, 2014

(54) POSITIVE LOCKED SLIM HOLE SUSPENSION AND SEALING SYSTEM WITH SINGLE TRIP DEPLOYMENT AND RETRIEVABLE TOOL

(75) Inventors: Delbert E. Vanderford, Cypress, TX (US); Ken M. Reed, Humble, TX (US)

(73) Assignee: Cameron International Corporation, Houston, TX (US)

( * ) Notice: Subject to any disclaimer, the term of this patent is extended or adjusted under 35 U.S.C. 154(b) by 533 days.

(21) Appl. No.: 13/130,304

(22) PCT Filed: Jan. 12, 2010

(86) PCT No.: PCT/US2010/020810

§ 371 (c)(1),
(2), (4) Date: May 19, 2011

(87) PCT Pub. No.: WO2010/096218

PCT Pub. Date: Aug. 26, 2010

(65) Prior Publication Data

US 2011/0226487 A1 Sep. 22, 2011

Related U.S. Application Data

(60) Provisional application No. 61/153,189, filed on Feb. 17, 2009.

(51) Int. Cl.
*E21B 19/00* (2006.01)
*E21B 33/04* (2006.01)
*E21B 33/047* (2006.01)

(52) U.S. Cl.
USPC ..... 166/379; 166/381; 166/85.1

(58) Field of Classification Search
USPC ..... 166/381, 71, 85.1, 85.5, 208, 217, 379, 166/75.14
See application file for complete search history.

(56) References Cited

U.S. PATENT DOCUMENTS 3,177,703 A * 4/1965 Waters et al. ..... 73/40.5 R
3,548,934 A * 12/1970 Hutchison ..... 166/368

(Continued)

FOREIGN PATENT DOCUMENTS

EP 0535277 4/1993

OTHER PUBLICATIONS

PCT Search Report and Written Opinion of PCT Application No. PCT/US2010/020810 mailed May 20, 2010.

*Primary Examiner* — Daniel P Stephenson
(74) *Attorney, Agent, or Firm* — Fletcher Yoder P.C.

(57) ABSTRACT

A tool is provided for installing a mandrel in a wellhead assembly. The tool includes an assembly having multiple independently translatable and rotatable members. The tool includes an inner member disposed in an inner sleeve. The inner member may be disposed in a first position and second position, such that in the first position the inner sleeve freely rotates and in the second position rotation of the inner sleeve causes rotation of the inner member. An outer sleeve is disposed over the inner sleeve and may be coupled to a hold down ring. The inner member may be coupled to mandrel. The tool may be inserted into a wellhead assembly and the outer rotated to engage the hold down ring, the inner and outer sleeve may be translated axially to allow rotation of the inner member to disengage the tool from the mandrel.

22 Claims, 19 Drawing Sheets

(56) References Cited

U.S. PATENT DOCUMENTS

| | | | | | |
|---|---|---|---|---|---|
| 3,972,546 | A * | 8/1976 | Putch | 285/18 |
| 4,416,472 | A * | 11/1983 | Fowler et al. | 285/3 |
| 4,807,705 | A * | 2/1989 | Henderson et al. | 166/348 |
| 4,811,784 | A * | 3/1989 | Theiss | 166/208 |
| 4,836,288 | A * | 6/1989 | Wester | 166/348 |
| 8,272,434 | B2 * | 9/2012 | Garcia | 166/78.1 |
| 2012/0285678 | A1 * | 11/2012 | Thornburrow et al. | 166/206 |
| 2013/0056282 | A1 * | 3/2013 | Robottom | 175/320 |

* cited by examiner

POSITIVE LOCKED SLIM HOLE SUSPENSION AND SEALING SYSTEM WITH SINGLE TRIP DEPLOYMENT AND RETRIEVABLE TOOL

CROSS-REFERENCE TO RELATED APPLICATIONS

This application claims priority to and benefit of PCT Patent Application No. PCT/US2010/020810, entitled "Positive Locked Slim Hole Suspension and Sealing System with Single Trip Deployment and Retrievable Tool," filed Jan. 12, 2010, which is herein incorporated by reference in its entirety, and which claims priority to and benefit of U.S. Provisional Patent Application No. 61/153,189, entitled "Positive Locked Slim Hole Suspension and Sealing System with Single Trip Deployment and Retrievable Tool", filed on Feb. 17, 2009, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling and/or extraction operations.

In a mineral extraction system, it is desirable to have as large a "hole" as possible. That is, the larger the output from the well and the equipment allowing extraction from the well, the faster the mineral can be extracted from the well. However, equipment used during operation of the mineral extraction system, such as mandrels, tubing strings, and the associated installation and suspension equipment, occupy space in the bore of the bowl, head, or flange that receives the tubing string. To maximize output from the well, it may be desirable to use as much area of the bowl, head, or flange as possible for flow of the mineral.

Additionally, when installing mandrels, tubing strings or other equipment, it is desirable to minimize trips down the "hole," as each trip into and out of the wellhead system to run tubing strings or other equipment adds time and cost to the setup, operation, and maintenance of the mineral extraction system. Further, some equipment often requires multiple trips "down hole" to install and/or remove the equipment.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain exemplary embodiments of the present technique include a system and method that addresses one or more of the above-mentioned challenges of installing equipment in a mineral extraction system. As explained in greater detail below, the disclosed embodiments include a suspension and sealing system having a single trip deployment and retrieval tool. The tool includes an assembly having multiple independently translatable and rotatable members. The tool may include an inner tubular member and an inner sleeve. The inner tubular member is disposed inside the inner sleeve. In a first position, the inner sleeve may freely rotate around the inner tubular member. In a second position, the inner tubular member may engage protrusions of an anti-rotation ring rotation coupled to the inner sleeve, such that rotation of the inner sleeve causes rotation of the inner tubular member. An outer sleeve may be coupled to and disposed over the inner sleeve. The outer sleeve may be coupled to a hold down ring, and the inner tubular member may be coupled to a mandrel to install the hold down ring and mandrel into a wellhead assembly.

Figure 1:
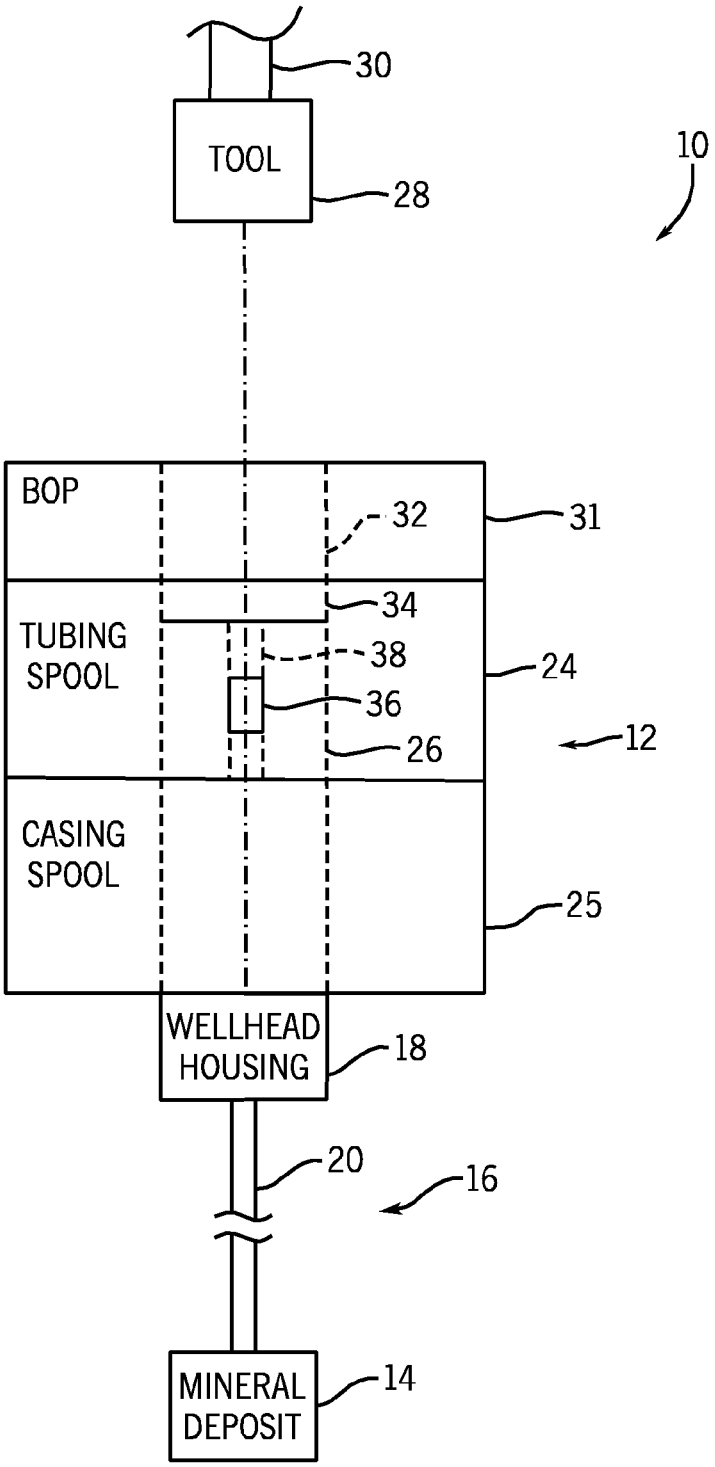
FIG. 1 is a block diagram that illustrates a mineral extraction system in accordance with an embodiment of the present invention.

FIG. 1 is a block diagram that illustrates an embodiment of a mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead housing 18 and a well-bore 20. The wellhead housing 18 generally includes a large diameter hub that is disposed at the termination of the well-bore 20. The wellhead housing 18 provides for the connection of the wellhead 12 to the well 16.

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, and provide for the injection of chemicals into the well-bore 20 (down-hole). In the illustrated embodiment, the wellhead 12 includes, a tubing spool 24 (also referred to as a tubing head), a casing spool 25 (also referred to as a casing bowl), and a hanger 26 (e.g., a tubing hanger or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a running tool that is lowered (e.g., run) from an offshore vessel to the well 16 and/or the wellhead 12. In other embodiments, such as surface systems, the tool 28 may include a device suspended over and/or lowered into the wellhead 12 via a crane or other supporting device. After installation or retrieval of a component, such as a tubing hanger as described below, a "Christmas tree" may be installed onto the tubing spool.

A blowout preventer (BOP) 31 may also be included, either as a part of the tree 22 or as a separate device. The BOP may consist of a variety of valves, fittings and controls to prevent oil, gas, or other fluid from exiting the well in the event of an unintentional release of pressure or an overpressure condition. Further, the BOP 31 may provide fluid communication with the well 16. For example, the BOP 31 includes a bore 32. The bore 32 provides for completion and workover procedures, such as the insertion of tools (e.g., the hanger 26) into the well 16, the injection of various chemicals into the well 16 (down-hole), and the like.

The tubing spool 24 provides a base for the BOP 31. Typically, the tubing spool 24 is one of many components in a modular subsea or surface mineral extraction system 10 that is run from an offshore vessel or surface system. The tubing spool 24 includes a tubing spool bore 34. The tubing spool bore 34 connects (e.g., enables fluid communication between) the bore 32 and the well 16. Thus, the tubing spool bore 34 may provide access to the well bore 20 for various completion and worker procedures. For example, components can be run down to the wellhead 12 and disposed in the tubing spool bore 34 to seal-off the well bore 20, to inject chemicals down-hole, to suspend tools down-hole, to retrieve tools down-hole, and the like.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, mineral extraction systems 10 employ various mechanisms, such as hangers, mandrels, seals, plugs and valves, to control and regulate the well 16. For example, plugs and valves are employed to regulate the flow and pressures of fluids in various bores and channels throughout the mineral extraction system 10. For instance, the illustrated hanger 26 (e.g., tubing hanger or casing hanger) is typically disposed within the wellhead 12 to secure tubing and casing suspended in the well bore 20, and to provide a path for hydraulic control fluid, chemical injections, and the like. The hanger 26 includes a hanger bore 38 that extends through the center of the hanger 26, and that is in fluid communication with the tubing spool bore 34 and the well bore 20. Pressures in the bores 20 and 34 may manifest through the wellhead 12 if not regulated.

A mandrel 36 may be seated and locked in the tubing spool 24 (or the casing spool 25) to install and suspend a tubing string or other component, and to isolate the interior of the tubing spool 24 or casing spool 25 of the wellhead assembly 12 from pressure. Similar sealing devices may be used throughout mineral extraction systems 10 to regulate fluid pressures and flows. In some embodiments, the tubing spool 24, casing spool 25, and hanger 26 may be adapted to receive multiple mandrels 36 and tubing strings. However, as mentioned above, the limited cross-sectional area of the tubing spool 24 or casing spool 25 may increase the difficulty of installing multiple mandrels 36 or tubing strings, as well as requiring undesirable multiple trips into the wellhead assembly 12. FIGS. 2-20 illustrate an embodiment of the present invention that provides for easier installation of the mandrels 36 in a single trip into the wellhead assembly 12.

Figure 2:
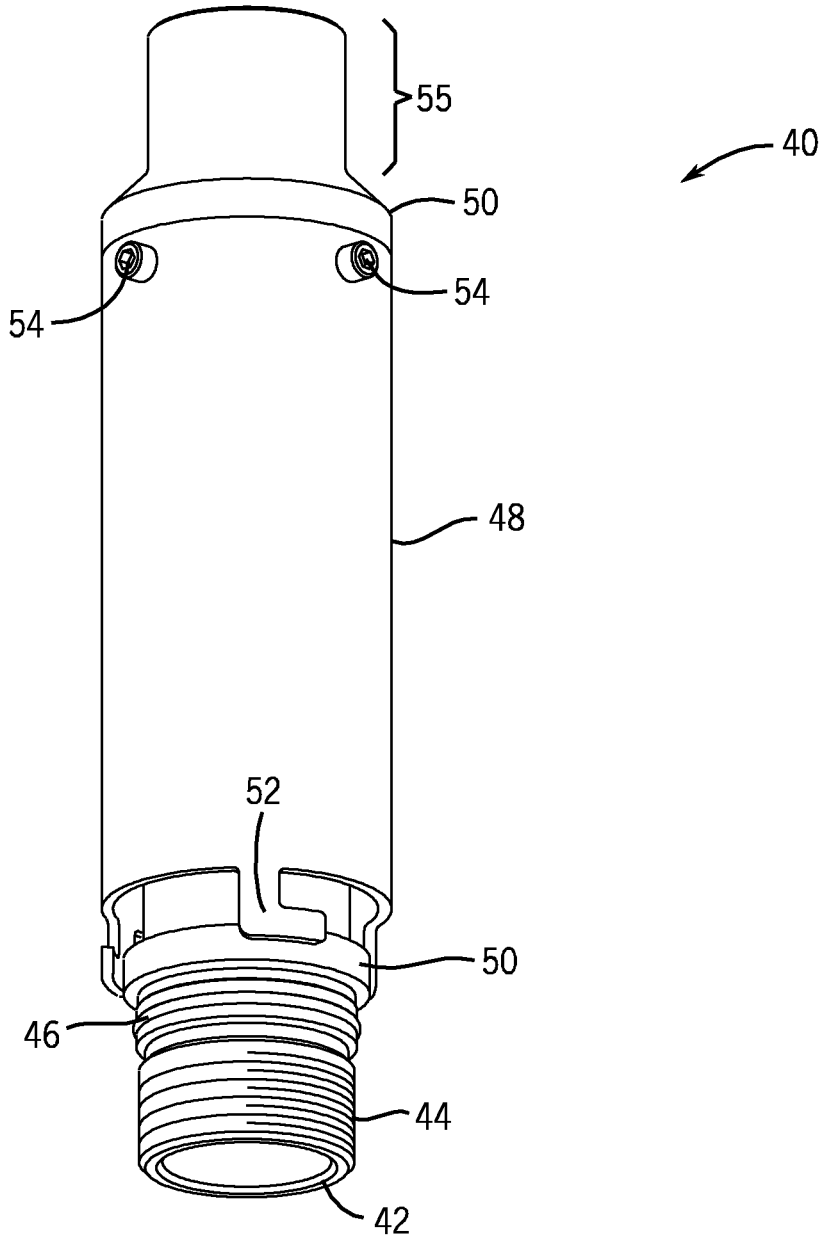
FIG. 2 is a perspective view of an assembled tool that provides a single trip installation and retrieval of a mandrel into a wellhead assembly in accordance with an embodiment of the present invention.

FIG. 2 is a perspective view of an embodiment of an assembled tool 40 that provides a single trip installation and retrieval of the mandrel 36 into the wellhead assembly 12. As shown in FIG. 2, the assembled tool 40 includes an inner tubular member 42 (e.g., an inner annulus) having threads 44 and an annular seal 46. As explained further below, the threads 44 couple the tubular member 42 to the mandrel 36. The tool 40 includes an outer sleeve 48 (e.g., an outer annulus) and an inner sleeve 50. The outer sleeve 48 includes one or more "J-shaped" protrusions 52. The outer sleeve 48 is also configured to receive one or more bolts 54 that secure the outer sleeve 48 to the inner sleeve 50. In other embodiments, screws, pins, or any other suitable fastener may be used to secure the outer sleeve 48 to the inner sleeve 50. The inner sleeve 50 includes an upper portion 55 having a reduced diameter. The upper portion 55 provides an attachment point for an insertion or retrieval attachment.

Figure 3:
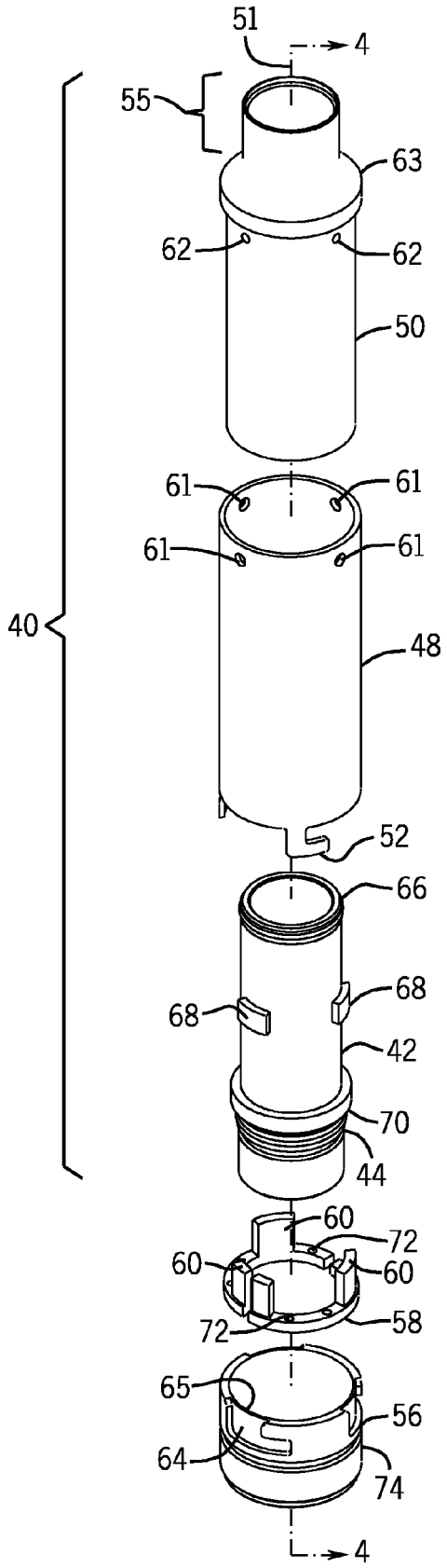
FIG. 3 is an exploded view of the tool of FIG. 2, an anti-rotation ring, and a hold down ring in accordance with an embodiment of the present invention.

FIG. 3 is an exploded view of an embodiment of the tool 40 positioned above a hold down ring 56 and an anti-rotation ring 58. The anti-rotation ring 58 includes one or more protrusions 60. Although the hold down ring 56 is shown as two sections, it should be appreciated that when assembled with the tool 40 the anti-rotation ring 58 assembles into a single unit. When assembled, the tool 40, the hold down ring 56, the anti-rotation ring 58, and the mandrel 36 are generally positioned concentrically around a central axis 57.

The inner sleeve 50 includes one or more receptacles 62 to allow securing of the outer sleeve 48, and also provides a lip 63 that abuts the outer sleeve 48 when the tool 40 is assembled. The receptacles 62 may be threaded to provide engagement with the bolts 54 or other fasteners. The outer sleeve 48 may include one or more receptacles 61 that may be threaded to provide for insertion of the bolts 54 or other fasteners. To secure the outer sleeve 48 to the inner sleeve 50, the bolts 54 or other fasteners may be inserted through the receptacles 61 of the outer sleeve 48 and into the receptacles 62 of the inner sleeve 50.

As mentioned above, the outer sleeve 48 includes one or more generally "J-shaped" protrusions 52. Similarly, the hold down ring 56 includes one or more "J-shaped" recesses 64 configured to receive the protrusions 52 of the outer sleeve 48. When assembling the tool 40, the hold down ring 56 may be engaged with the outer sleeve 48 by inserting the protrusions 52 of the outer sleeve 48 into an opening 65 of the receptacles 64 and rotating the outer sleeve 48 until the protrusions 52 fully engage the receptacles 64. The engagement between the outer sleeve 48 and the hold down ring 56 enables rotation of the outer sleeve 48 to rotate and install the hold down ring 56, as described further below.

When the tool 40 is assembled, the inner tubular member 42 is disposed in the inner sleeve 50, and may include various features to interact or engage with the inner sleeve 50. As illustrated in FIG. 3, the inner tubular member 42 includes an upper annular seal 66 and tabs 68 extending generally radially from the inner tubular member 42. The upper annular seal 66 provides sealing with the interior of the inner sleeve 50 when the tool 40 is assembled.

As explained further below, when the tool 40 is assembled such that the inner tubular member 42 is in a first position, the tabs 68 of the inner tubular member 42 may engage the protrusions 60 such that rotation of the inner sleeve 50 causes rotation of the inner tubular member 42. In contrast, when the inner tubular member 42 is in a second position, the tabs 68 do not engage the protrusions 60 of the anti-rotation ring 58 so that the inner sleeve 50 (and the outer sleeve 48) may freely rotate around the inner tubular member 42. The inner tubular member 42 also includes a lip 70 that provides an abutment against the inner sleeve 50 when the tool 40 is assembled.

The anti-rotation ring 58 includes one or more receptacles 72 configured to receive a bolt or other fastener. For example, the receptacles 72 may be threaded to provide insertion of a bolt, screw, pin, or other suitable fastener to secure the anti-rotation ring 58 to the inner sleeve 50.

As explained further below, to secure the mandrel 36 the hold down ring 56 is installed in the wellhead assembly 12. The hold down ring 56 may be secured into the tubing spool 24 or casing spool 25 via threads 74. The hold down ring 56 secures the mandrel 36 in the tubing spool 24 to prevent axial movement of the mandrel 36 during operation of the wellhead assembly 12.

Figure 4:
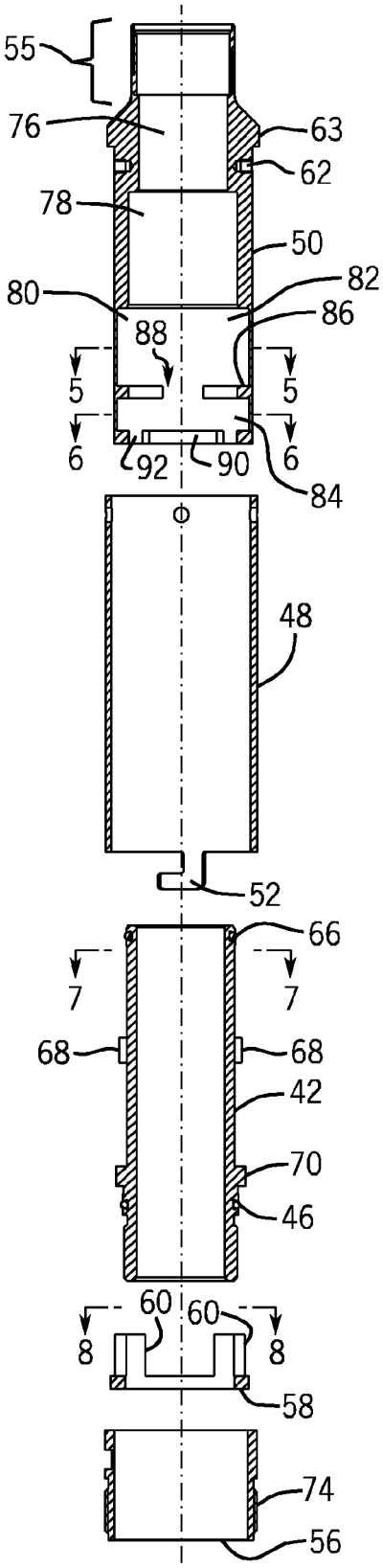
FIG. 4 is a cross-section of the exploded view of the tool taken along line 4-4 of FIG. 3 in accordance with an embodiment of the present invention.

FIG. 4 is a cross-section of an embodiment of the exploded tool 40 taken along line 4-4 of FIG. 3. As shown in FIG. 4, the inner sleeve 50 includes a first portion 76 having a first inner diameter, a second portion 78 having a second inner diameter, and a third portion 80 having a third inner diameter. In the embodiment, the first inner diameter may be less than the second inner diameter, and the second inner diameter may be less than the third inner diameter. The third portion 80 includes a first chamber 82 and a second chamber 84. The first chamber 82 and the second chamber 84 are separated by protrusions 86. As explained further below, the protrusions 86 define a space 88 to enable axial movement of the tabs 68, which in turn enables axial movement of the inner tubular member 42 inside the inner sleeve 50. The inner tubular member 42 may move until the tabs 68 abut the bottom second portion 78. Additionally, when the tool 40 is assembled, the upper annular seal 66 may be disposed in the second portion 78, sealing the tool 40. As the inner tubular member 42 moves axially, the upper annular seal 66 may remain disposed in the second portion 78. Thus regardless of the axial position of the inner tubular member 42, the tool 40 remains sealed up to that point at which the upper annular seal 66 is engaged with the upper portion 78.

Figure 5:
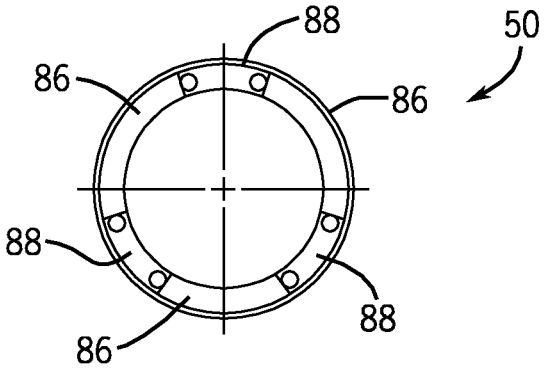
FIG. 5 is a cross-section of the inner sleeve of the tool taken along line 5-5 of FIG. 4 in accordance with an embodiment of the present invention.
Figure 6:
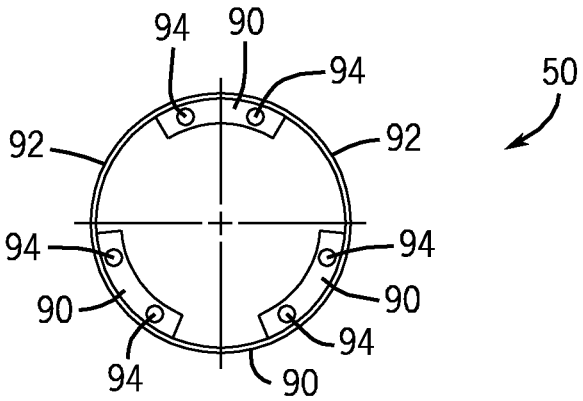
FIG. 6 is a cross-section of the inner sleeve of the tool taken along line 6-6 of FIG. 4 in accordance with an embodiment of the present invention.

FIG. 5 is a cross-section of the inner sleeve 50 taken along line 5-5 of FIG. 4. As seen in FIG. 5, three protrusions 86 define three spaces 88 to enable space for the tabs 68 to move axially between the first chamber 82 and the second chamber 84. FIG. 6 is a cross-section of the inner sleeve 50 taken along line 6-6 of FIG. 3. FIG. 6 illustrates three protrusions 90 at the base of the second chamber 84 of the inner sleeve 50. The protrusions 90 define three spaces 92 to enable space for the protrusions 60 of the anti-rotation ring 58 to move axially into the second chamber 84 when assembling the tool 40. The protrusions 90 also include receptacles 94 configured to receive a bolt, screw, pin or other fastener. The anti-rotation ring 58 may be secured to the inner sleeve 50 by inserting a bolt, screw, pin, or other fastener through the receptacles 72 of the anti-rotation ring 58 and into the receptacles 94 of the inner sleeve 50. Additionally, when the anti-rotation ring 58 is secured to the inner sleeve 50, the anti-rotation ring 58 captures the inner tubular member 42 within the sleeve 50. Specifically, the anti-rotation ring 58 blocks the inner tubular member 42 from moving axially out of the sleeve 50 by blocking the spaces 92.

Figure 7:
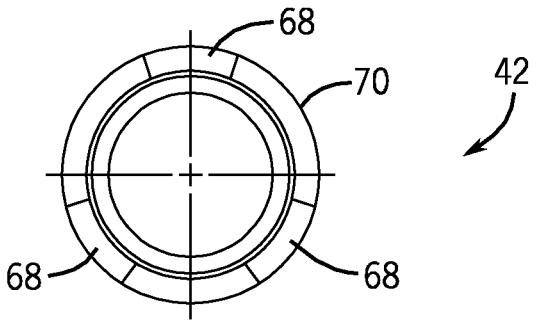
FIG. 7 is a top view of the inner tubular member of the tool in accordance with an embodiment of the present invention.

FIG. 7 is a top view of an embodiment of the inner tubular member 42 as shown by line 7-7 in FIG. 4. As mentioned above, the inner tubular member 42 includes three tabs 68 that extend radially from the inner tubular member 42. The three tabs 68 correspond to the spaces 88 and the spaces 92 of the inner sleeve 50, such that the tabs 68 may pass through the spaces 88 and spaces 92. Thus, when assembling the inner sleeve 50 over the inner tubular member 42, the tabs 68 are aligned such that they move through the spaces 92. Similarly, when moving inner tubular member 42 between the first position and the second position, the tabs 68 are aligned with the spaces 88 such that the may move axially through the spaces 88 and between the first chamber 82 and the second chamber 84. When the tabs 68 are in the second chamber 84 (e.g., the second position), the tabs 68 are captured axially by the protrusions 86 and 90. When the tabs 68 are in the first chamber 82 (e.g., the first position), the tabs 68 are captured axially between the protrusions 86 and the interface between portions 78 and 80.

Figure 8:
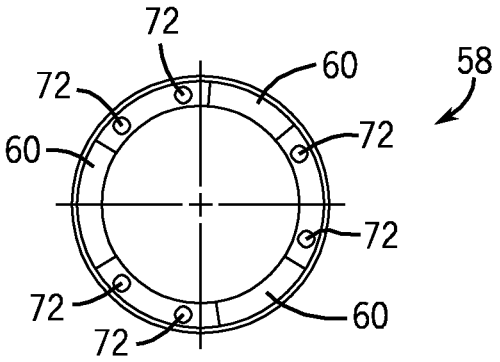
FIG. 8 is a top down view of the anti-rotation ring of the tool in accordance with an embodiment of the present invention.

FIG. 8 is a top view of the anti-rotation ring 58 as shown by line 8-8 in FIG. 4. As described above, the anti-rotation ring 58 may be secured to the inner tubular member 42 via bolts, screws, pins, or other fasteners inserted into the receptacles 72. When assembled onto the inner tubular member 42, the protrusions 60 of the anti-rotation ring 58 extend through the spaces 92 and into the second chamber 84 of the inner sleeve 50. The protrusions 60 engage the tabs 68 to block free rotation of the inner sleeve 50 when the inner tubular member 42 is positioned such that the tabs 68 are in the second chamber 74. The protrusions 60 fill the spaces 92 after the member 42 is rotated such that the tabs 68 move angularly from a first angular position axially aligned with the spaces 92 to a second angular position axially aligned with the spaces 88 and the protrusions 90.

Figure 9:
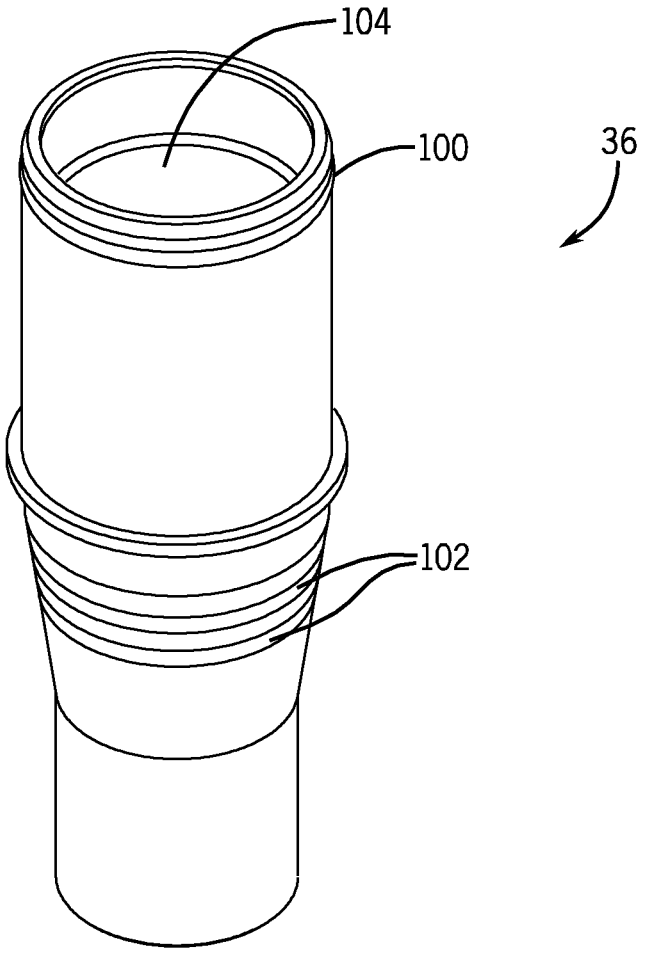
FIG. 9 is a perspective view of the mandrel that may be installed in the wellhead assembly by the tool of FIGS. 2-8 in accordance with an embodiment of the present invention.

FIG. 9 depicts an embodiment of the mandrel 36 that may be installed in the wellhead assembly 12 by the tool 40. The mandrel 36 includes an upper annular seal 100 and lower annular seals 102. The mandrel 36 also includes interior threads 104. The upper annular seal 100 provides sealing against the interior of the hold down ring 56 when the mandrel 36 and hold down ring 56 are installed in the wellhead assembly 12. The interior threads 104 mate to the threads 44 of the inner tubular member 42, providing a connection between the assembled tool 40 and the mandrel 36. As described further below, to remove the tool 40 from the mandrel 36, the inner tubular member 42 is rotated to disengage the threads 44 of the inner tubular member 42 from the interior threads 104 of the mandrel 36. In some embodiments, as discussed below, the mandrel 36 may be coupled to a tubing string.

Figure 10:
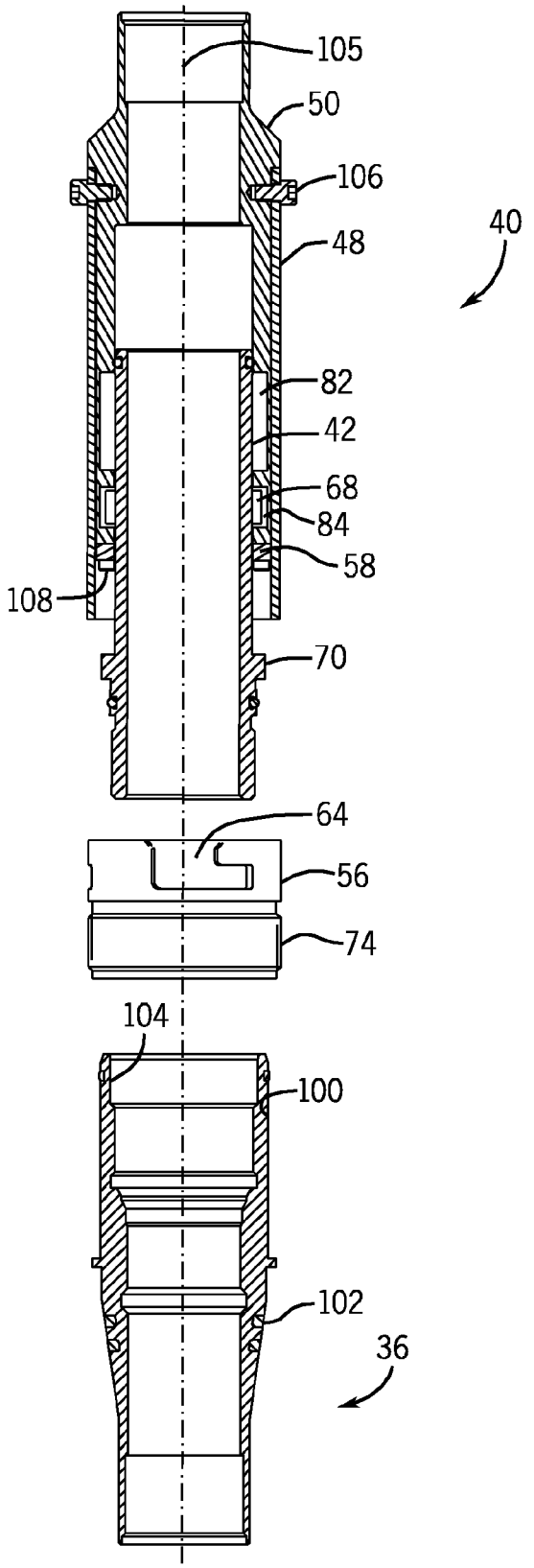
FIG. 10 is a cross-section of the partially assembled tool, the hold down ring, and the mandrel in accordance with an embodiment of the present invention.

FIG. 10 depicts a cross-section of an embodiment of a partially assembled tool 40. The hold down ring 56 and mandrel 36 are shown aligned with the tool 40 along a central axis 105. As seen in the partially assembled tool, the outer sleeve 48 is coupled to the inner sleeve 50 via bolts 106. As mentioned above, when operating the tool and installing the mandrel 36 and the hold down ring 56, the hold down ring 56 may be coupled to the outer sleeve 48 via the insertion and rotation of "J-shaped" protrusions 52 in the "J-shaped" recesses 64. The mandrel 36 may be coupled to the inner tubular member 42 via engagement of the threads 44 of the inner tubular member 42 with the interior threads 104 of the mandrel 36.

The anti-rotation ring 58 is disposed inside the outer sleeve 48, and secured to the bottom of the inner sleeve 50 via bolts 108. As described above, the protrusions 60 of the anti-rotation ring 58 extend into the second chamber 84 of the inner sleeve 50. The inner tubular member 42 is disposed inside the inner sleeve 50.

As illustrated in FIG. 10, the inner tubular member 42 is disposed inside the inner sleeve 50 such that the tabs 68 of the inner tubular member 42 are disposed inside the second chamber 84 of the inner sleeve 50. This position may be referred to as the "lower" position of the inner tubular member 42. In this position, rotation of the inner sleeve 50 rotates the inner tubular member 42 through contact between the tabs 68 and the protrusions 60 of the anti-rotation ring 58. The outer sleeve 48 also rotates via the connection to the inner sleeve 50. Thus, when the inner tubular member 42 is in the "lower" position, rotation of the tool 40 may rotate the threads 44 of the inner tubular member 42, enabling the inner tubular member 42 to be rotated into and out of engagement with the mandrel 36 via interior threads 104. As described further below, this "lower" position may be used to remove the tool 40 from the mandrel 36 after the hold down ring 56 and mandrel 36 are installed in the wellhead assembly 12.

Figure 11:
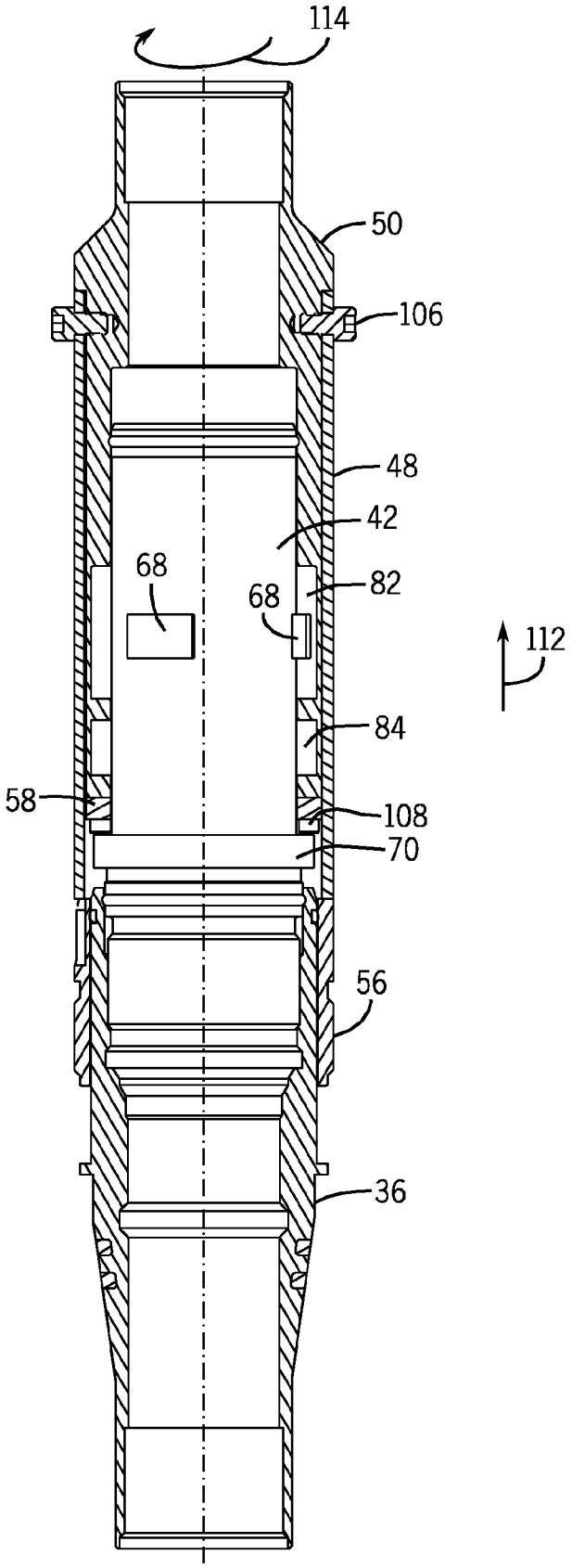
FIG. 11 is a cross-section of the assembled tool in preparation for installation of the hold down ring and the mandrel into a wellhead assembly in accordance with an embodiment of the present invention.

FIG. 11 illustrates a cross-section of the assembled tool 40 in preparation for installation of the hold down ring 56 and the mandrel 36 into the wellhead assembly 12. As described above, the tool 40 includes the inner sleeve 50 disposed within the outer sleeve 48, and the inner tubular member 42 disposed within the inner sleeve 50. The hold down ring 56 is coupled to the outer sleeve 48 via the "J-shaped" protrusions 52 and the corresponding recesses 64 on the hold down ring 56. The mandrel 36 is coupled to the inner tubular member 42 of the tool 40 via connection of the threads 44 of the inner tubular member 42 to the interior threads 104 of the mandrel 36. In this manner, both the hold down ring 56 and the mandrel 36 are secured to the tool 40, enabling the entire assembly to be inserted into the wellhead assembly 12.

In contrast to FIG. 10, in FIG. 11 the inner tubular member 42 is illustrated in an "upper" position. In the "upper" position, the tabs 68 of the inner tubular member 42 are disposed within the first chamber 82. The inner tubular member 42 may be moved between the "upper" and the "lower" position by aligning the tabs 68 with the spaces 88 and moving the inner sleeve 50 (and outer sleeve 48) in the axial direction generally indicted by arrow 112. As the inner sleeve 50 and outer sleeve 48 are moved in the axial direction indicated by arrow 112, the tabs 68 pass through the spaces 88 and move from the first chamber 82 to the second chamber 84 or vice-versa.

In the "upper" position, the tabs 68 may freely move (e.g., rotate) within the first chamber 82. The protrusions 60 of the anti-rotation ring 58 remain fixed in the second chamber 84. In the "upper" position, the inner sleeve 50 and outer sleeve 48 may be freely rotated around the inner tubular member 42 while the inner tubular member 42 remains stationary. The free rotation of the inner sleeve 50 and outer sleeve 48 enables free rotation of the hold down ring 56 without affecting the threaded coupling between the inner tubular member 42 and the mandrel 36. Thus, to install the hold down ring 56, the inner sleeve 50 and outer sleeve 48 may be rotated in the angular direction generally indicated by the arrow 114, rotating the hold down ring 56 to mate the threads 74 of the hold down ring 56 with corresponding threads in the wellhead assembly 12.

After the hold down ring 56 is secured to in the wellhead assembly, the inner sleeve 50 and outer sleeve 48 may be moved in the upwardly axial direction indicated by the arrow 112, moving the inner tubular member 42 to the "lower" position. As opposed to the freely rotating "upper" position, in the "lower" position rotation of the inner sleeve 50 rotates the inner tubular member 42. The inner tubular member 42 may be rotated to disengage the inner tubular member 42 from the mandrel 36. As the inner tubular member 42 is rotated, the tool 40 may be moved in the axial direction as the threads 44 are disengaged from the interior threads 104 of the mandrel 36. After the inner tubular member 42 is disengaged from the mandrel 36, the tool 40 is free to be removed from the wellhead assembly 12.

To install the tool 40, the entire assembly of the tool 40, the hold down ring 56, and the mandrel 36 may be inserted into the wellhead assembly 12. The outer sleeve 48 and inner sleeve 50 are set such that the inner tubular member 42 is in the first position, e.g., the tabs 68 are in the first chamber 82. To thread the hold down ring 56 into the wellhead assembly, the tool 40 is rotated, such that the inner sleeve 50 and outer sleeve 48 are rotated, which in turn rotates the hold down ring 56 through engagement of the "J-shaped" protrusions 52 and recesses 64. As the tool 40 is rotated, the inner tubular member 42 does not rotate and the inner sleeve 50 and outer sleeve 48 freely rotate around the inner tubular member 42. After installation of the hold down ring 56, the tool 40 rotated such that the tabs 68 of the inner tubular member 42 rotate into alignment with the spaces 88. The tool 40 may be lifted axially, moving the tabs 68 into the second chamber 84, e.g., moving the inner tubular member 42 into the second position. The tool 40 may then be rotated to unthread the inner tubular member 42 from the mandrel 36. Because the inner tubular member 42 is in the second position, rotation of the inner sleeve 50 and outer sleeve 48 rotates the inner tubular member through engagement of the tabs 68 with the protrusions 60 of the anti-rotation ring 58.

Figure 12:
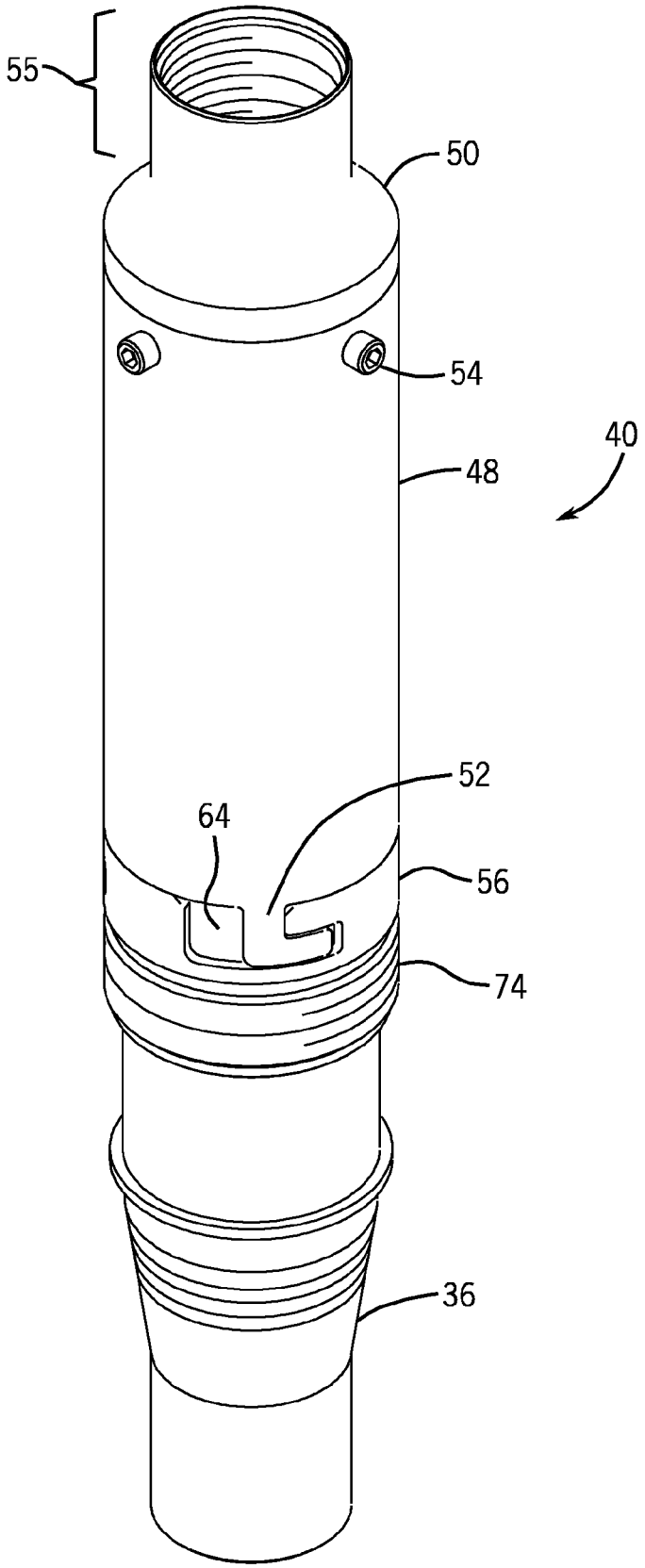
FIG. 12 is a perspective view of the assembled tool, the hold down ring, and the mandrel prior to insertion into a wellhead assembly in accordance with an embodiment of the present invention.

FIGS. 12-21 illustrate installation, operation, and removal of the tool 40 with a wellhead assembly 12. FIG. 12 depicts the assembled tool 40, hold down ring 56, and mandrel 36 prior to insertion into a wellhead assembly 12. As described above, the "J-shaped" protrusions 52 may engage the receptacles 64 (e.g., bolt receptacles) of the hold down ring 56 to secure the hold down ring 56 to the outer sleeve 48. Prior to installation, the tool 40 is assembled such that the inner tubular member 42 is in the "upper position" so that the inner sleeve 50 and outer sleeve 48 freely rotate without rotating the inner tubular member 42.

Figure 13:
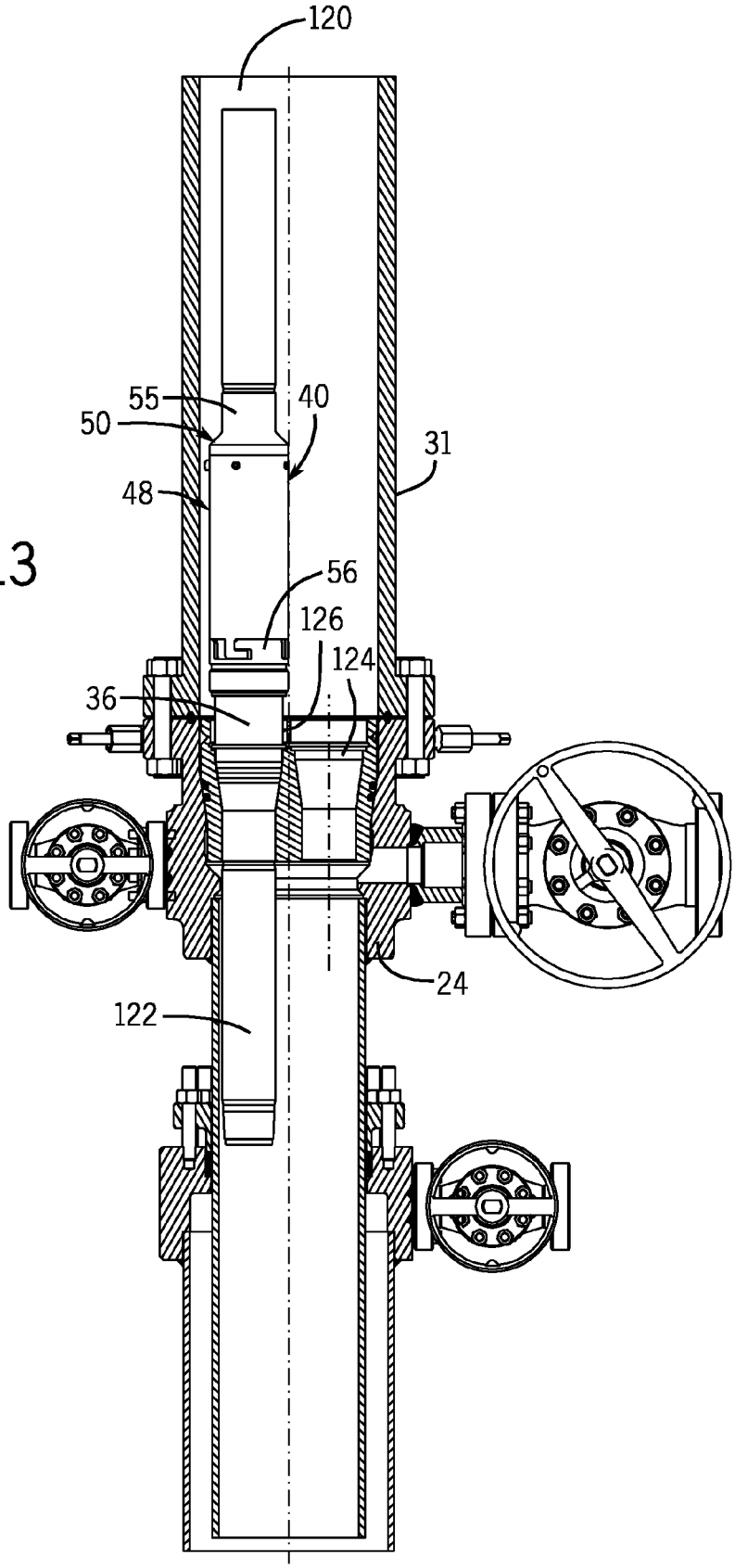
FIG. 13 depicts insertion of the tool, the hold down ring and the mandrel 36 into a wellhead assembly in accordance with an embodiment of the present invention.

FIG. 13 depicts insertion of the tool 40, hold down ring 56, and mandrel 36 into the wellhead assembly 12. In one embodiment, the tubing spool 24 may be coupled to the blowout preventer 31. In other embodiments, the tool 40 may be installed through or into any component of the wellhead assembly 12, such as the blowout preventer 31, the tubing spool 24 and/or the casing spool 25. The tool 40 may be held and inserted into the bore 32 of the tubing spool 24 via an attachment 120. The attachment 120 couples to the reduced diameter upper portion 55 of the inner sleeve 50, and may extend out through the top of the wellhead assembly 12. An operator may manipulate the tool 40, such as translating or rotating, though the attachment 120.

The mandrel 36 may be coupled to a tubing string 122 that is also disposed in the tubing spool 24. In some embodiments, one or more additional mandrels 124 may be installed in the tubing spool 24. The tool 40 enables insertion of the mandrel 36 next to previously installed mandrels 124, without removal of the additional mandrels 124 and in a single trip into the wellhead assembly 12. To secure the mandrel 36 via the hold down ring 56, the tubing hanger 26 may include threads 126 configured to mate with the threads 74 of the hold down ring 56.

Figure 14:
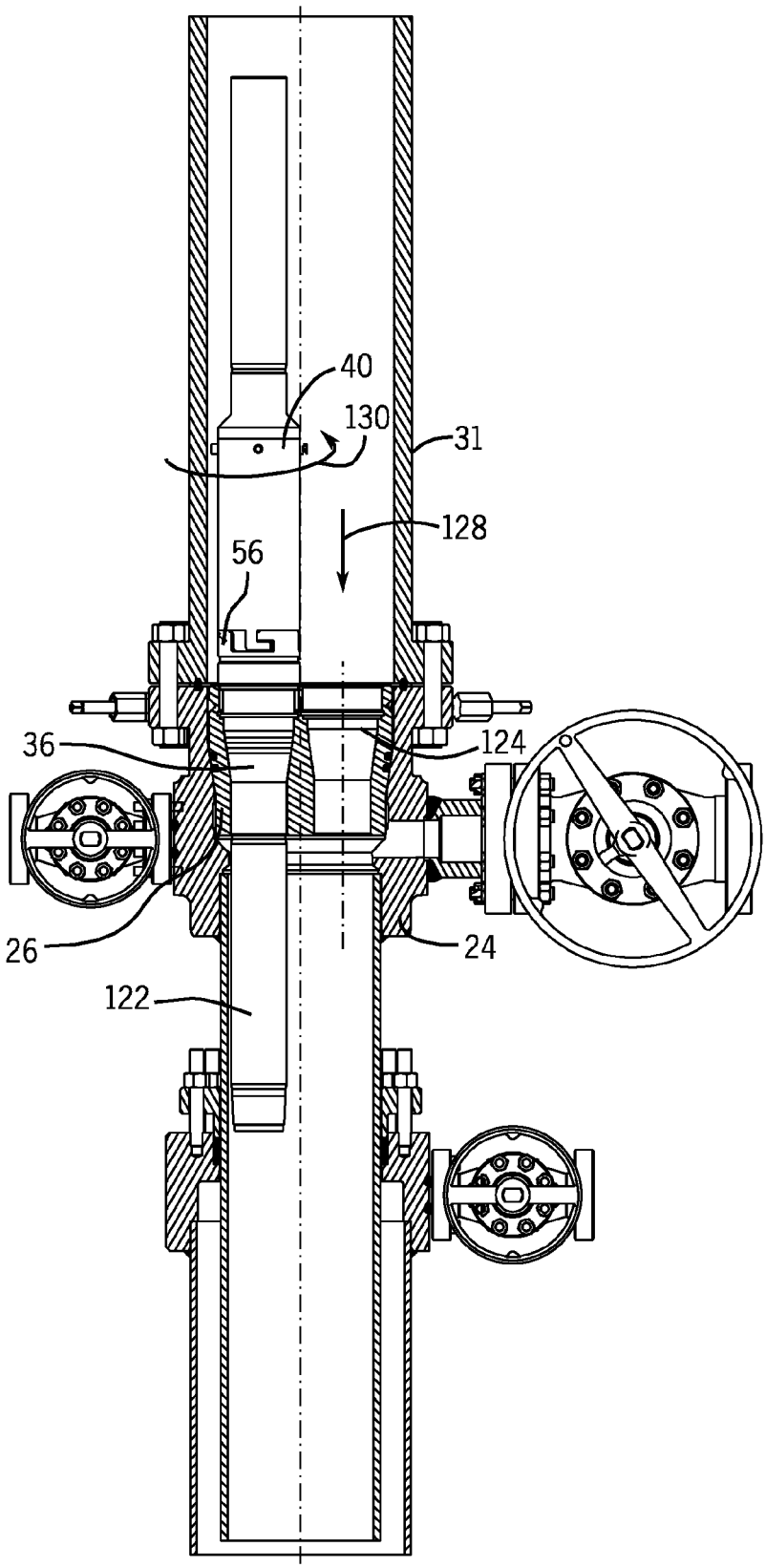
FIG. 14 depicts landing of the hold ring into a tubing hanger of the wellhead assembly in accordance with an embodiment of the present invention.

In FIG. 14, after the mandrel 36 moves into position into the tubing spool 24 the tool 40 moves the hold down ring 56 in the axial direction generally indicated by arrow 128, until the threads 74 of the hold down ring 56 engage the threads 126 of the tubing hanger 26. For example, an operator may manipulate the tool 40 into position via the attachment 120, by axially moving the tool 40 and rotating the tool 40 counterclockwise (as indicated by arrow 130) until the threads 74 "jump" onto the threads 126 of the tubing hanger 26.

Figure 15:
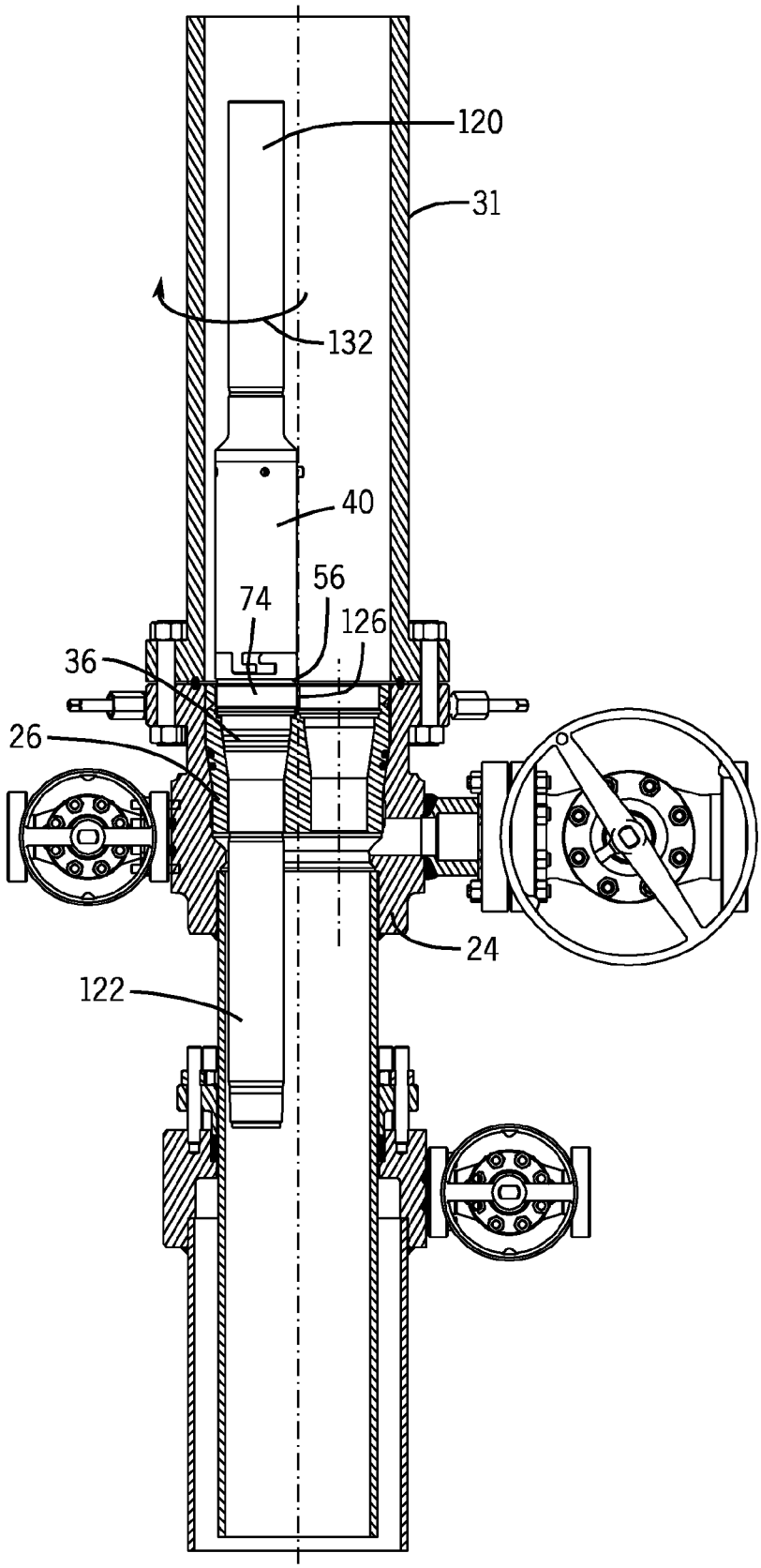
FIG. 15 depicts rotation of the tool to engage the hold down ring into the tubing hanger of the wellhead assembly in accordance with an embodiment of the present invention.

As depicted in FIG. 15, the tool 40 may be rotated (e.g., in the clockwise direction generally indicated by arrow 132) so that the threads of the hold down ring 56 begin to engage with threads 126 of the tubing hanger 26. As the inner tubular member 42 is in the "upper position," rotation of the tool 40 via the attachment 120 freely rotates the inner sleeve 50 and outer sleeve 48, enabling the hold down ring 56 to be rotated into engagement without affecting the connection between the inner tubular member 42 and the mandrel 36.

Figure 16:
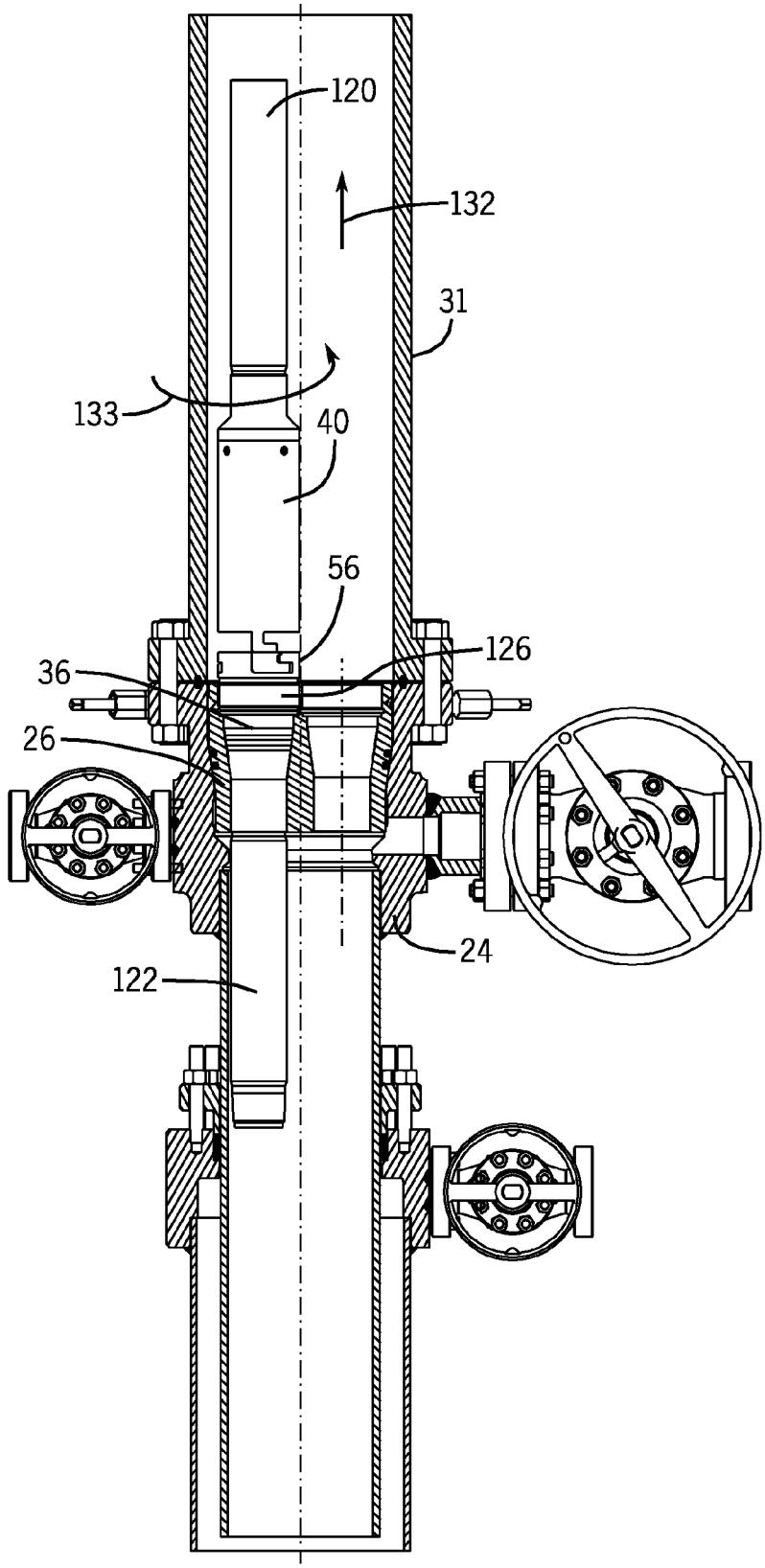
FIG. 16 depicts the installed hold down ring and removal of the tool from the mandrel in accordance with an embodiment of the present invention.

In FIG. 16, the hold down ring 56 is shown fully engaged with the hanger 26. In this position, the threads 74 of the hold down ring 56 are coupled to the threads 126 of the tubing hanger 26 disposed in the tubing spool 24. The hold down ring 56 prevents axial movement of the mandrel 36, generally locking the mandrel 36 in place inside the wellhead assembly 12.

After installing the mandrel 36 and securing the hold down ring 56, the tool 40 may be removed from the wellhead assembly 12. To remove the tool from the wellhead assembly 12, the tool 40 is removed from engagement with the hold down ring 56 and then from engagement with the mandrel 36.

As shown in FIG. 10, to remove the tool 40 from the hold down ring 56, the tool 40 may be slightly rotated to ensure the "J-shaped" protrusions 52 of the outer sleeve 48 are disengaged from the "J-shaped" recesses 64 of the hold down ring 56. Removing the tool 40 from the hold down ring 56 involves alignment of the "J-shaped" protrusions 52 with the openings 65 of the recesses 64. Additionally, as shown in the transition of the inner tubular member 42 between the "upper" and "lower" positions, the tabs 68 of the inner tubular member 42 may be aligned with the spaces 88 to enable the inner sleeve 50 to move axially relative to the inner tubular member 42.

The tool 40 may be moved in the axial direction indicated by arrow 132, moving the inner tubular member 42 to the "lower" position. As described in FIG. 10, in the "lower" position, the inner sleeve 50 and outer sleeve 48 cannot freely rotate around the inner tubular member 42. The inner tubular member 42 may be rotated by rotating the inner sleeve 50 via the attachment 120. Thus, to disengage the inner tubular member 42 from the mandrel 36, the tool 40 may be rotated in the counterclockwise direction generally indicated by arrow 133 until the threads 44 of the inner tubular member 42 disengage the interior threads 104 of the mandrel 36.

It should be appreciated that any rotation during the installation and removal illustrated above in FIGS. 13-16 may be performed in a direction opposite to that described above, depending on the orientation of the threads of the spool 24, hold down ring 56, and/or any other component.

Figure 17:
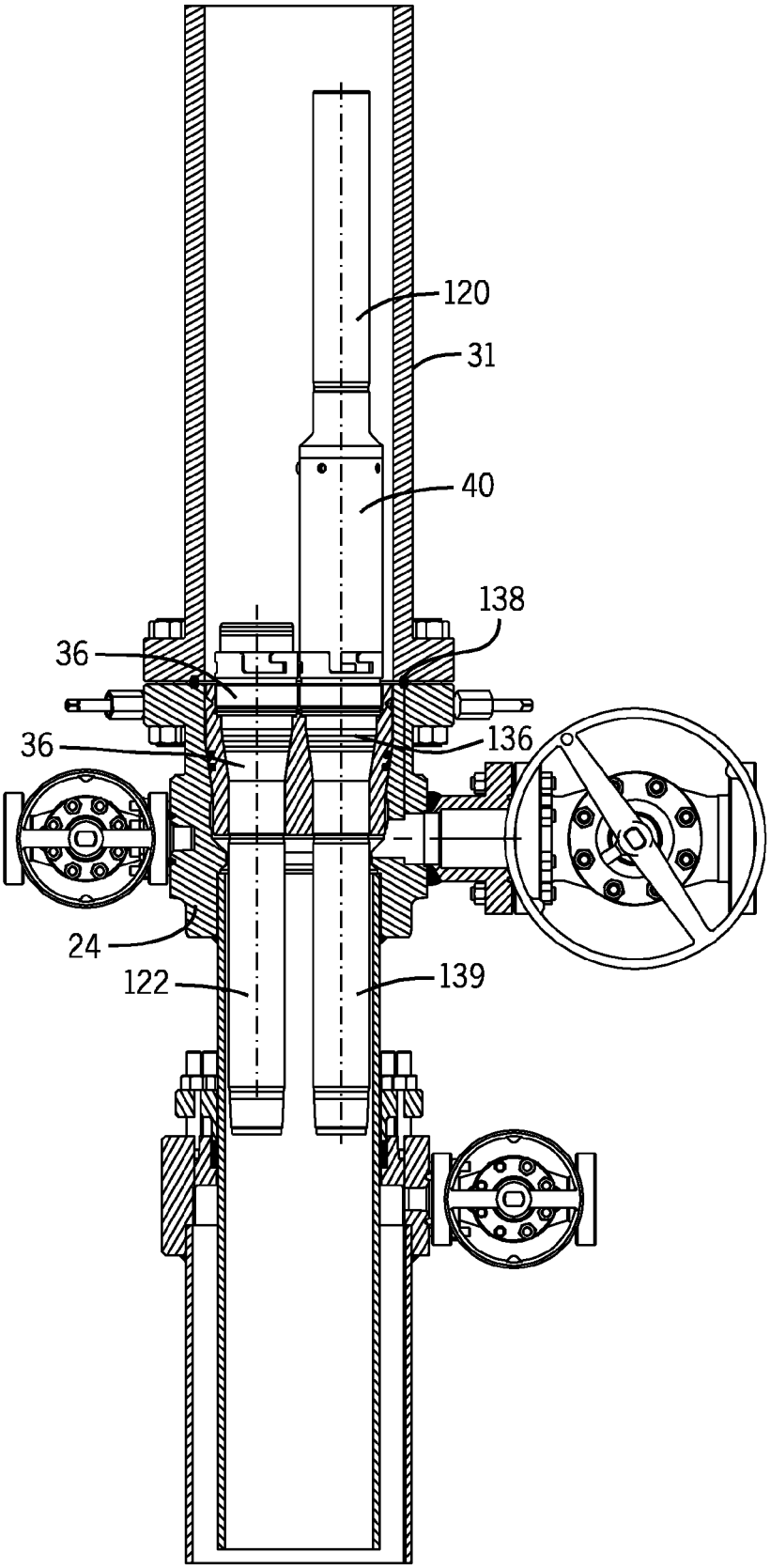
FIG. 17 depicts installation of a second mandrel and hold down ring in the wellhead assembly in accordance with an embodiment of the present invention.
Figure 18:
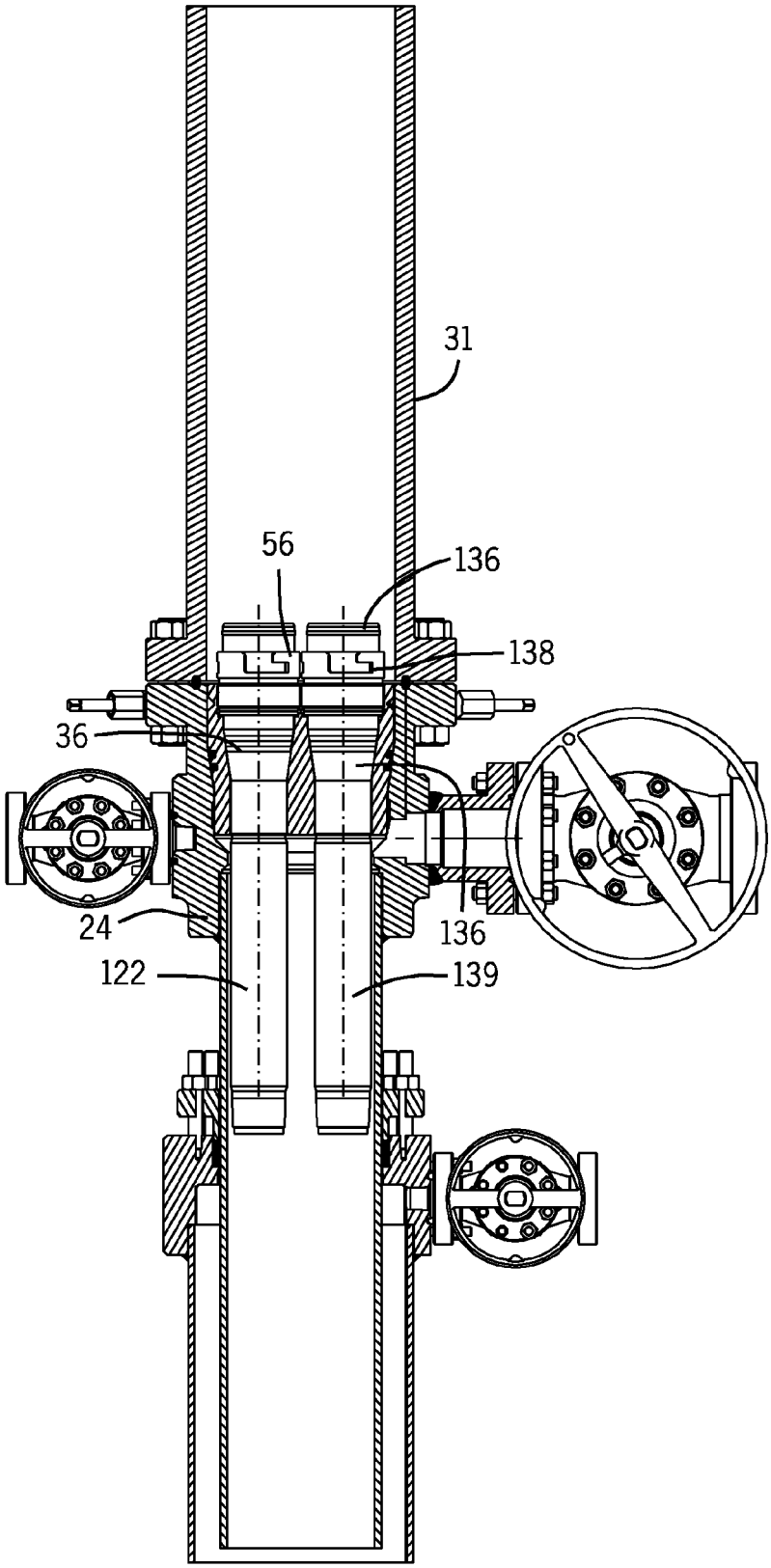
FIG. 18 depicts two hold down rings and mandrels installed in the wellhead assembly in accordance with an embodiment of the present invention.

As shown in FIG. 17, after the tool 40 is disengaged from the mandrel 36, the tool 40 may be removed from the wellhead assembly 12. As also illustrated in FIG. 17, further operation of the wellhead assembly 12 may include installation of a second mandrel 136 and a hold down ring 138, which may be installed in a similar manner using the tool 40. The second mandrel 136 may be coupled to another tubing string 139. In other embodiments, a third, fourth, or any number of mandrels may be installed in the wellhead assembly 12. The installation of additional mandrels 36 only involves the cross-sectional area of the wellhead component required for the mandrel itself. FIG. 18 illustrates both mandrels 36 and 136 installed, sealed, and locked via the hold down rings 56 and 138 respectively.

Figure 19:
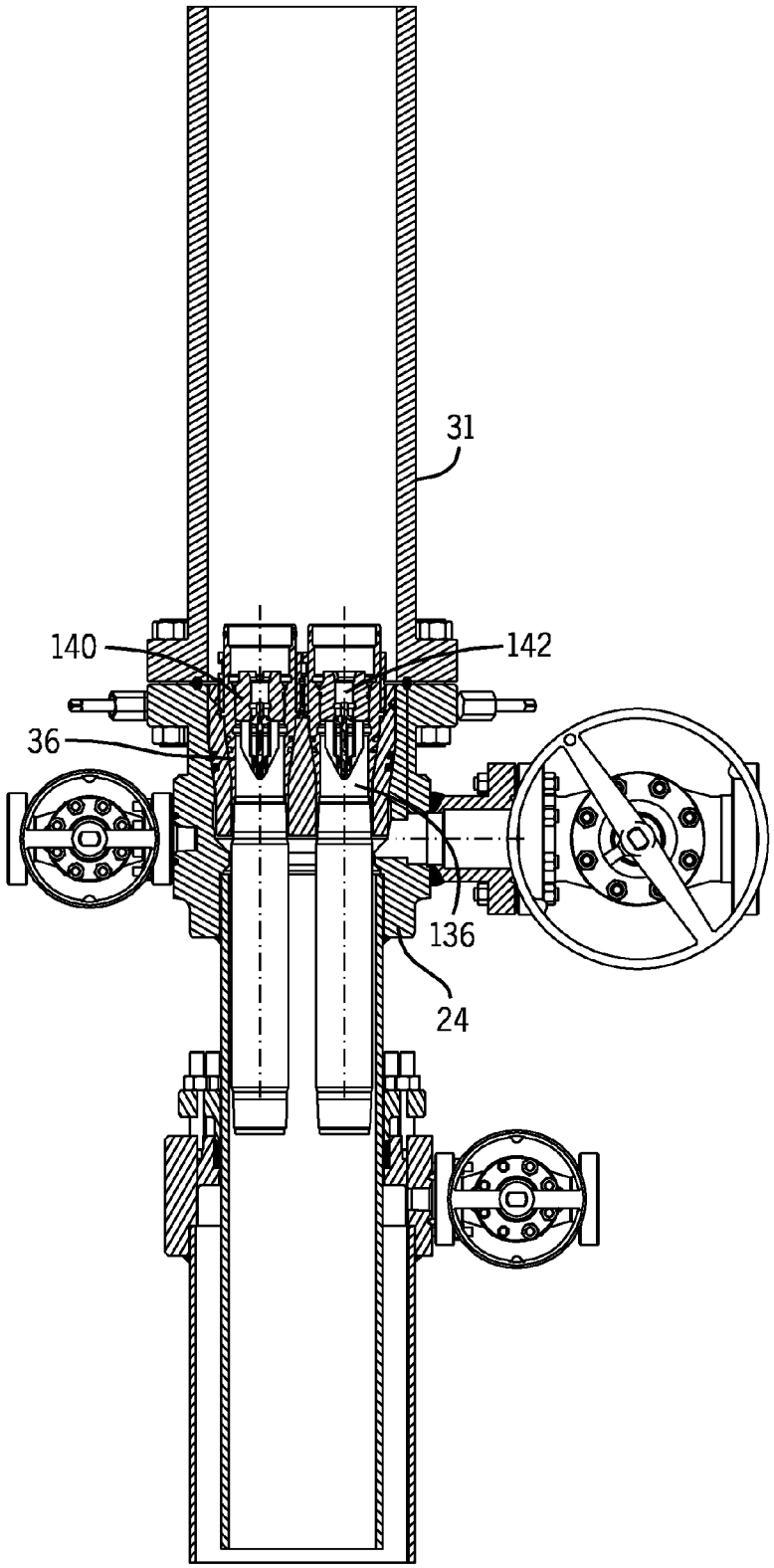
FIG. 19 depicts insertion of two backpressure valves into the mandrels of FIG. 18 in accordance with an embodiment of the present invention.

As shown in FIG. 19, further operation of the wellhead assembly 12 may include insertion of a backpressure valve 140 into the mandrel 36 and a backpressure valve 142 into the mandrel 136. The backpressure valves 140 and 142 may generally plug and seal the tubing strings 122 and 139 respectively, providing additional safety from pressure conditions in the well 16 so that further operations may be performed. For example, in one such operation, the blowout preventer 31 may be removed from the wellhead assembly 12.

Figure 20:
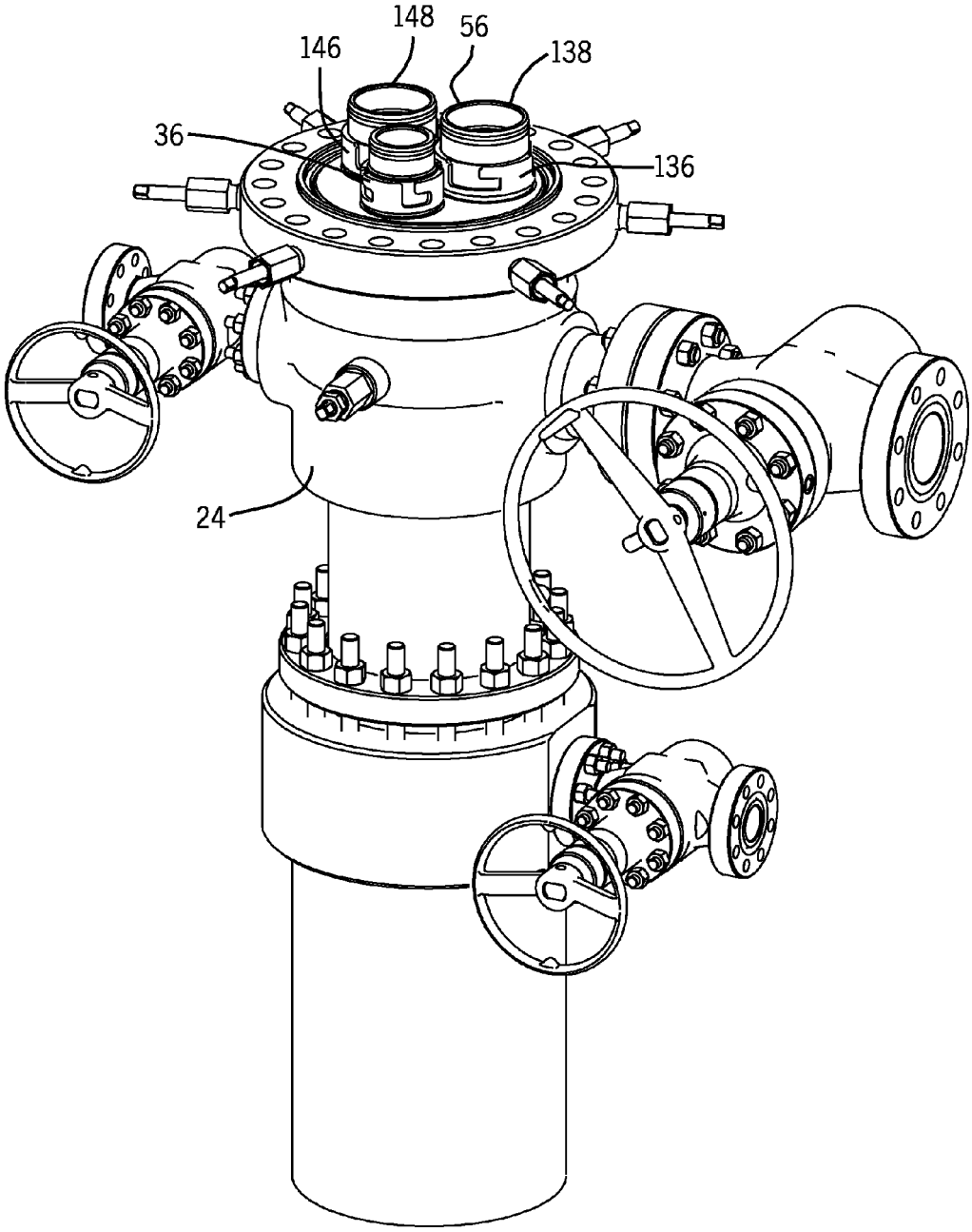
FIG. 20 is a perspective view of three mandrels installed in a wellhead assembly with the blowout preventer removed in accordance with an embodiment of the present invention.

FIG. 20 illustrates an embodiment of the wellhead assembly 12 with the blowout preventer 31 removed from connection to the tubing spool 24. In this embodiment, the mandrel 36, the second mandrel 136, and a third mandrel 146 are installed in the tubing spool 24 and secured via hold down rings 56, 138, and 148 respectively. By running multiple mandrels 36, 136, and 146, and associated tubing strings, greater flow from the well 16 may be achieved through the cross-sectional area of the bore 34 of the tubing spool 24. As discussed above, use of the tool 40 enables each mandrel 36, 136, and 146 to be installed in a single trip using only that cross-sectional area required for the mandrel itself. Thus, each mandrel 36, 136, and 146 may be installed without disturbing the position of any previously installed mandrels in the tubing spool 24.

Figure 21:
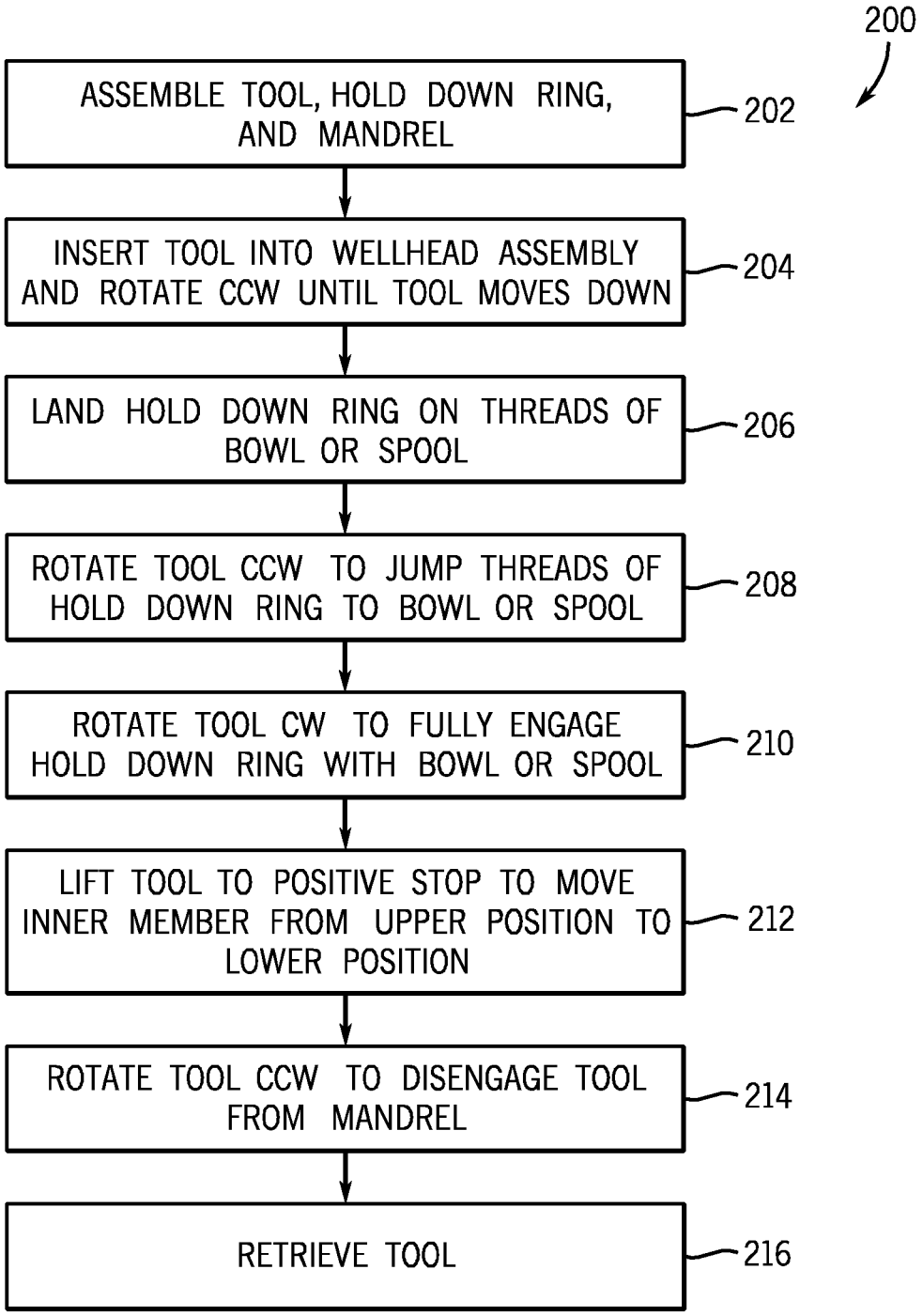
FIG. 21 is a block diagram of a process of operating the tool and installing a hold down ring and a mandrel in accordance with an embodiment of the present invention.

FIG. 21 depicts an embodiment of a process 200 for operating the tool 40 and installing the mandrel 36 into the wellhead assembly 12. Initially, the tool, hold down ring 56, and mandrel 36 may be assembled (block 202) as illustrated in FIG. 12. The tool 40 is then inserted into the wellhead assembly 12 and rotated counter-clockwise until the tool 40 moves down to seat the mandrel 36 in the hanger 26 (block 204), also landing the hold down ring 56 on the threads of the tubing hanger 26 (block 206). The tool 40 is rotated counterclockwise to "jump" the threads of the hold down ring 56 onto the threads of the tubing hanger 26 (block 208). After the threads of the hold down ring 56 are connected to the threads of the tubing hanger 26, the tool 40 is rotated clockwise, freely rotating the inner sleeve 50 and the outer sleeve 48, to fully engage the hold down ring 56 with the hanger 26 (block 210).

After the hold down ring 56 is fully engaged, the tool 40 is lifted (moved axially) to move the inner member 42 from the upper position to the lower position (block 212) and enable rotation of the inner member 42. The tool 40 is rotated counterclockwise to disengage the tool 40 from the mandrel 36 (block 214) by disengaging the threads of the inner member 42 from the threads of the mandrel 36. The tool 40 is then retrieved from the wellhead assembly 12 (block 216).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A tool for installing a mandrel in a wellhead assembly, comprising:

an inner tubular member comprising a first coupling configured to couple to the mandrel, wherein the inner tubular member comprises one or more tabs extending radially from the inner tubular member;

an inner sleeve disposed over the inner tubular member, wherein the inner sleeve comprises a first chamber and a second chamber, the inner tubular member is configured to move along a longitudinal axis of the tool to move the tabs between the first and second chambers, the inner sleeve is rotatable independently of the inner tubular member while the tabs are disposed in the first chamber, and the inner sleeve and the inner tubular member are rotatable together while the tabs are interlocked with a lock feature in the second chamber; and an outer sleeve coupled to and at least partially disposed over the inner sleeve, wherein the outer sleeve is configured to rotate with the inner sleeve while the tabs are disposed in the first chamber, and the outer sleeve comprises a second coupling configured to couple to a hold down ring, and the tool is configured to run in and install the mandrel and the hold down ring in a single trip.

2. The tool of claim 1, wherein the lock feature comprises a plurality of axial protrusions extending into the second chamber and configured to engage the tabs.

3. The tool of claim 1, wherein the first coupling of the inner tubular member comprises first threads configured to mate with first mating threads of the mandrel.

4. The tool of claim 1, wherein the second coupling of the outer sleeve comprises a plurality of protrusions configured to mate with recesses in the hold down ring.

5. The tool of claim 4, wherein the protrusions and recesses have a J-shape configured to engage and disengage via rotation and axial translation.

6. The tool of claim 4, comprising the hold down ring, wherein the hold down ring is configured to retain the mandrel in the wellhead assembly.

7. The tool of claim 6, comprising the mandrel removably coupled to the inner tubular member, wherein the mandrel is releasable from the inner tubular member after the hold down ring is secured to the wellhead assembly.

8. The tool of claim 1, wherein the first chamber is an upper chamber and the second chamber is a lower chamber.

9. The tool of claim 1, wherein the inner tubular member comprises an annular seal, wherein the annular seal seals a portion of the tool at any position of the inner tubular member in the inner sleeve.

10. A method of installing a mandrel into a wellhead assembly, comprising:

running in and inserting a tool coupled to a hold down ring and the mandrel into a component of the wellhead assembly for installation in a single trip, wherein the tool comprises at least one sleeve and a tubular member disposed in a coaxial arrangement;

rotating the at least one sleeve in an unlocked configuration relative to the tubular member of the tool such that the hold down ring rotates into engagement with the component;

axially moving the at least one sleeve of the tool from a first axial position to a second axial position relative to the tubular member, wherein the first axial position has the at least one sleeve in the unlocked configuration relative to the tubular member, and the second axial position has the at least one sleeve in a locked configuration relative to the tubular member; and rotating the at least one sleeve of the tool in the locked configuration with the tubular member such that tool disengages from the mandrel.

11. The method of claim 10, wherein the tubular member comprises a first coupling configured to couple to the mandrel, the at least one sleeve comprises an outer sleeve having a second coupling configured to couple to the hold down ring, the at least one sleeve comprises an inner sleeve disposed radially between the tubular member and the outer sleeve, and the inner and outer sleeves move together between the first and second axial positions.

12. The method of claim 10, wherein the tool comprises an anti-rotation ring having one or more axial protrusions disposed between the tubular member and the inner sleeve, the tubular member comprises one or more radial protrusions, the axial and radial protrusions are axially offset from one another in the unlocked configuration, and the axial and radial protrusions are axially aligned with one another in the locked configuration.

13. The method of claim 10, wherein the anti-rotation ring is coupled to the inner sleeve.

14. The method of claim 10, comprising inserting the tool coupled to a second hold down ring and a second mandrel into the component of the wellhead assembly.

15. The method of claim 10, comprising inserting a back-pressure valve into the mandrel.

16. An assembly for a mineral extraction system, comprising:

a tool comprising:

an inner sleeve comprising a first chamber and a second chamber;

an outer sleeve partially disposed over the inner sleeve;

an inner tubular member partially disposed inside the inner sleeve, comprising a plurality of tabs extending radially from the surface of the inner tubular member;

wherein the inner tubular member is movable between a first axial position and second axial position via movement of the inner sleeve along a longitudinal axis of the tool, wherein the first axial position has the tabs in the first chamber and the second axial position has the tabs in the second chamber a plurality of protrusions extending into the second chamber, wherein the plurality of protrusions engage the tabs when the inner tubular member is in the second axial position;

a hold down ring coupled to the outer sleeve; and a mandrel coupled to the inner tubular member, wherein the inner and outer sleeves are configured to rotate together independent from the inner tubular member to rotate the hold down ring while the tabs are disposed in the first chamber, wherein the inner and outer sleeves and the inner tubular member are configured to rotate together to rotate the mandrel while the tabs are disposed in the second chamber, and the tool is configured to run in and install the mandrel and the hold down ring in a single trip.

17. The assembly of claim 16, wherein the outer sleeve comprises a plurality of second protrusions configured to couple to a plurality of recesses of the hold down ring.

18. The assembly of claim 17, wherein the plurality of second protrusions comprise J-shaped protrusions.

19. The assembly of claim 16, wherein the inner sleeve comprises a plurality of second protrusions separating the first chamber from the second chamber.

20. The assembly of claim 16, wherein the hold down ring is partially disposed over the mandrel.

21. A system for installing or removing a mandrel in a mineral extraction system, comprising:

a tool, comprising:

a first tubular comprising a J-shaped structure configured to mate with a corresponding J-shaped structure of a hold down ring; and a second tubular having threads configured to mate with threads of the mandrel, wherein the second tubular comprises a first axial position that is rotatable with the tool, and the second tubular comprises a second axial position that is not rotatable with the tool;

wherein the tool is configured to rotate the first tubular in a first rotational direction without rotating the second tubular, while the second tubular is in the first axial position, to thread the hold down ring in the mineral extraction system; and wherein the tool is configured to rotate the first tubular in a second rotational direction opposite from the first rotational direction, followed by axial translation of the first tubular, such that the tool disengage the J-shaped structures to release the hold down ring from the tool;

wherein the tool is configured to translate the second tubular from the first axial position to the second axial position to set the second tubular for rotation along with the tool; and wherein the tool is configured to rotate the second tubular in the second axial position to unthread the mandrel from the second tubular, wherein the tool is configured to run in and install the mandrel and the hold down ring in a single trip.

22. A tool for installing a mandrel in a wellhead assembly, comprising:

an inner tubular member configured to couple to the mandrel, wherein the inner tubular member comprises threads configured to mate with threads of the mandrel, and the inner tubular member comprises one or more tabs extending radially from the inner tubular member;

an inner sleeve disposed over the inner tubular member, wherein the inner sleeve comprises a first chamber and a second chamber configured to receive the tabs, such that when the tabs are in the first chamber the inner sleeve is rotatable independently of the inner tubular member, and when the tabs are in the second chamber the inner sleeve and the inner tubular member are rotatable together; and an outer sleeve coupled to and at least partially disposed over the inner sleeve.

* * * * *